United States Patent [19]

Beauregard

[11] Patent Number: 4,476,598

[45] Date of Patent: Oct. 16, 1984

[54] COMBINATION ARROWHEAD REMOVING AND MUZZLE-LOADING TOOL

[76] Inventor: LeR Beauregard, 2496 S. 550 East, Bountiful, Utah 84010

[21] Appl. No.: 334,319

[22] Filed: Dec. 24, 1981

[51] Int. Cl.[3] ..... B25F 1/00

[52] U.S. Cl. ..... 7/170; 29/255

[58] Field of Search ..... 29/254, 255, 270; 81/463; 7/170

[56] References Cited

U.S. PATENT DOCUMENTS

| | | | |
|---|---|---|---|
| 2,941,429 | 6/1960 | Mason | 81/463 X |
| 3,529,497 | 9/1970 | Brooks | 29/254 X |
| 3,750,500 | 8/1973 | Peterson | 81/463 |
| 3,835,489 | 9/1974 | Lagace et al. | 7/170 |
| 4,150,469 | 4/1979 | Hoggard | 29/254 |

*Primary Examiner*—James G. Smith

*Attorney, Agent, or Firm*—Thorpe, North & Western

[57] ABSTRACT

A device for starting a ball in a muzzle-loading firearm and for removing arrowheads lodged in trees or the like, where the arrowheads include threaded fingers extending rearwardly for receiving a correspondingly threaded opening in the forward end of an arrow shaft. The arrow shaft is screwable onto and unscrewable from the threaded finger of the arrowhead and when the arrow, with the arrowhead, is shot into a tree, the arrow shaft is simply unscrewed from the arrowhead. The device of the invention includes an elongate shank, one end of which has a threaded opening therein for screwing onto the threaded finger of the arrowhead, a stop disposed at the other end of the shaft, and a weighted sleeve disposed about the shank to slide therealong. After the elongate shank is screwed onto the arrowhead embedded in the tree, the weighted sleeve is repetitively moved against the stop on the shank to force the device away from the tree and thereby extract the arrowhead from its embedded position. A tamping rod is attachable to the other end of the shaft so that the device may be used to start a ball in the barrel of a muzzle-loading firearm. The tamping rod includes a concave tamping head for placement against the ball to force the ball down into the barrel.

2 Claims, 2 Drawing Figures

COMBINATION ARROWHEAD REMOVING AND MUZZLE-LOADING TOOL

BACKGROUND OF THE INVENTION

This invention relates to a device for removing arrowheads lodged in trees or the like without damaging the arrowheads.

Because of the frequency with which arrows become lodged in trees or other obstructions in the course of bow hunting or similar sport bow shooting, it is quite common now for arrowheads to be made with a threaded finger which extends rearwardly from the arrowhead, and for arrow shafts to be made with threaded openings in the forward end of the shaft. In use, an arrowhead is screwed onto the end of the arrow shaft so that in the event that the arrow becomes embedded in a tree, the arrow shaft may then simply be unscrewed from the arrowhead and removed from the tree. In this fashion, at least the arrow shaft can be saved for use another time.

Even though the arrow shaft can be easily removed with the above arrow configuration, it is very difficult to remove arrowheads from trees or similar obstacles without damaging the arrowhead. Presently, the arrowheads are typically removed from a tree by simply digging or carving about the arrowhead with a knife. This method is extremely time consuming and, if prying of the arrowhead is necessary, it is not uncommon for the arrowhead to be damaged.

SUMMARY OF THE INVENTION

It is an object of the invention to provide a device for quickly and easily removing arrowheads embedded in trees or the like.

It is another object of the invention to provide a device which may be attached to the rear of an arrowhead embedded in a tree to facilitate removal of the arrowhead.

It is also an object of the invention to provide such a device which may be manually operated to effect removal of an arrowhead from a tree or similar obstacle.

It is an additional object of the invention, in accordance with one aspect thereof, to provide such a device which may be used for starting a ball in a muzzle-loading firearm.

The above and other objects of the invention are realized in a specific illustrative embodiment thereof which includes an elongate shank, one end of which has structure for attaching to the rear end of an arrowhead, a weight element disposed on the shank to move therealong, and a stop element located at or near the other end of the shank to prevent movement of the weight element therepast. The weight element is manually movable along the shank to apply a striking force against the stop element to thereby effectuate removal from a tree or similar obstacle of an arrowhead lodged therein. The shank is simply attached to the rear end of the arrowhead as it is embedded in the tree, and then the weight element is successively forced against the stop element to cause removal of the arrowhead from the tree.

In accordance with one aspect of the invention, an elongate tamping rod is provided for affixing onto one end of the shank. The shank and rod may then be used for starting a ball into the barrel of a muzzle-loading firearm.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Figure 1:
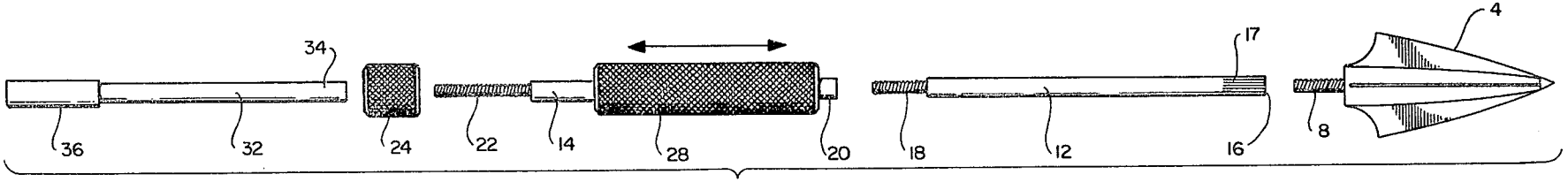
FIG. 1 shows a side, elevational, exploded view of apparatus made in accordance with the principles of the present invention.
Figure 2:
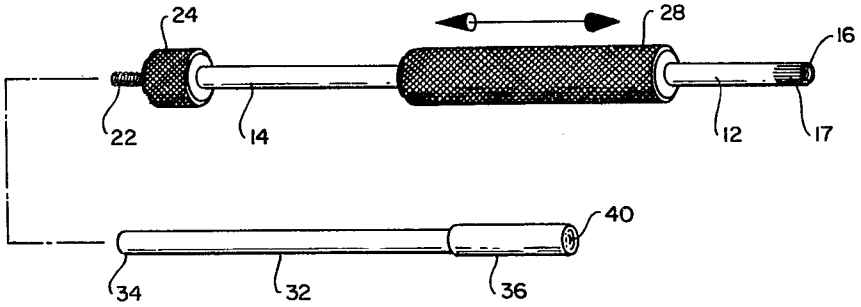
FIG. 2 shows a perspective view of such apparatus.

Referring to FIGS. 1 and 2, there is shown a device for removing arrowheads, such as arrowhead 4, which have become lodged in trees or other obstacles while bow shooting. The arrowheads to be removed will include some type of structure at the rear end thereof for attaching to and detaching from the forward end of an arrow shaft. In the embodiment of the drawings, arrowhead 4 includes a threaded finger 8 which extends axially and rearwardly of the arrowhead as shown. This threaded finger is provided for allowing the screwing of the arrowhead onto the forward end of an arrow shaft which, in this case, would include a correspondingly threaded opening. Such a configuration of an arrow shaft and arrowhead is provided to, among other things, allow the unscrewing of the arrow shaft from the arrowhead in the event that the arrow becomes embedded in a tree or similar obstacle. In such event, the arrow shaft may simply be unscrewed from the arrowhead if it turns out that the arrowhead cannot be removed from the tree. Also, if an arrowhead becomes damaged through frequent use, it may be desirable to simply unscrew the arrowhead from the shaft and replace it with a new arrowhead.

The apparatus or device for removing arrowheads includes a pair of generally cylindrical elongate shanks 12 and 14 which may be screwed together in a co-linear relationship. A forward end 16 of the shank 12 includes a threaded opening which may be screwed onto the threaded finger 8 of the arrowhead. The threaded opening extends axially from the forward end 16 rearwardly a distance sufficient to accommodate the threaded finger 8. The rear end 18 of the shank 12 includes threads on the exterior therof for accommodating a correspondingly threaded opening in the forward end 20 of the shaft 14 to allow joining the shafts 12 and 14 together. The rear end of shaft 14 also includes threads 22 for receiving a correspondingly threaded nut 24. The nut 24 acts as a rear stop element to prevent movement thereby of a weighted sleeve 28 which is disposed to move along the shanks 12 and 14.

The forward end 16 of the shank 12 is dimensioned to have substantially the same or a smaller diameter as an arrow shaft to facilitate insertion of the shank into an opening made by the arrowhead and shaft in a tree or similar obstacle to allow the shank to contact and be screwed onto the threaded finger 8 of the arrowhead. (This, of course, would apply where the arrowhead, including the threaded finger 8, were embedded completely within the tree or obstacle.) The forward end 16 of the shank 12 also includes striations 17 on the exterior thereof to facilitate gripping the shank so that it can be readily unscrewed from an arrowhead.

The weighted sleeve 28 is constructed in the form of a cylinder having a bore axially located therein, into which the shanks 12 and 14 are inserted. Advantageously, the distance between the stop 24 and the forward end 16 of the shank is at least about twice or greater than twice the length of the sleeve 28 to allow sufficient freedom to move the sleeve forcefully against the stop 24. It has been found that a sleeve weighing about seven ounces operates satisfactorily to cause removal of an arrowhead embedded in a tree as will be described momentarily. The exterior surface of the sleeve 28 may include cross hatched grooves or similar provision to facilitate gripping the sleeve by hand. Steel or other rugged material may be used to construct the shanks 12 and 14 and sleeve 28. Advantageously, the stop 24 is constructed of aluminum so that no spark will be created when it is struck by the sleeve 28.

The device above-described is used to remove arrowheads from trees or the like by simply assembling shanks 12 and 14, and the stop 24, with the sleeve 28 disposed on the shanks, and then screwing the forward end of the shank 12 onto the threaded finger 8 of an arrowhead embedded in a tree. The sleeve 28 is then repeatedly moved with force against the nut 24 until the assembly is driven away from the tree to pull the arrowhead therefrom. The arrowhead is then simply unscrewed from the end of the shank 12 so that it can again be used on an arrow shaft.

Provision of two shanks 12 and 14 which may be taken apart allows for disassembly of the apparatus into compact component parts for ease in carrying and storage.

The apparatus of the invention may be adapted for use as a ball setter or starter tool for starting a ball into the barrel of a muzzle-loading firearm. Components used for this include a third elongate shank 32, an upper end 34 of which includes a threaded opening for receiving the threaded end 22 of the shank 14. The lower end of the shank 32 has mounted thereon a generally cylindrical brass tamping head 36. The free end 40 of the tamping head 36 is concave to fit about balls to be loaded into the firearms. Brass is the preferable material for the tamping head so as to minimize the chance of creating sparks when the head rubs against the firearm barrel.

In use, the shank 32 is screwed onto that portion of the threaded end 22 of the shank 14 which extends through and out the other side of the nut 24 (shown in FIG. 2) when the nut is screwed all the way onto the threaded end 22. The concave end 40 of the tamping head 36 may then be placed over a ball inserted into the barrel of a firearm, and the sleeve 24 then repeatedly moved against the nut 24 to thereby drive the ball down into the firearm barrel. The described apparatus is used to force a ball far enough into a gun barrel to enable use of a conventional tamping rod to force the ball the rest of the way into position in the gun.

It should be understood that the above-described embodiment is only illustrative of the application of the principles of the present invention and that numerous other alternative embodiments could be described without departing from the spirit and scope of the invention. For example, stop 24 could be replaced with a pin which extends laterally from the shank 14. Also, the sleeve 28 could take a variety of shapes so long as it was appropriately weighted to allow the application of a force against the stop 24. The appended claims are intended to cover all described embodiments and alternative embodiments which the present invention might have.

What is claimed is:

1. Apparatus for removing arrowheads lodged in trees or the like, where the arrowheads include structure at the rear end thereof for attaching to and detaching from the forward end of an arrow shaft, said apparatus comprising an elongate shank, one end of which includes means for attaching the shank to the attachment structure of the arrowhead, weight means disposed on the shank to move therealong, and stop means located at or near the other end of the shank to prevent movement of the weight means therepast, said weight means being manually moveable along the shank to apply a striking force against the stop means to thereby effectuate removal from a tree or the like of an arrowhead lodged therein to which the apparatus is attached, a tamping rod, a first end of which is attachable to said other end of the shank, and a second end of which includes a concave tamping head for placement against a ball to be inserted into the barrel of a muzzle-loading firearm.

2. Apparatus as in claim 1 wherein said tamping head is made of brass.

* * * * *